US011980270B2

(12) United States Patent
Bowden

(10) Patent No.: US 11,980,270 B2
(45) Date of Patent: May 14, 2024

(54) MAKE-UP ORGANIZER

(71) Applicant: Lakesha Bowden, Whiteville, TN (US)

(72) Inventor: Lakesha Bowden, Whiteville, TN (US)

( * ) Notice: Subject to any disclaimer, the term of this patent is extended or adjusted under 35 U.S.C. 154(b) by 445 days.

(21) Appl. No.: 17/460,677

(22) Filed: Aug. 30, 2021

(65) Prior Publication Data

US 2022/0087381 A1 Mar. 24, 2022

Related U.S. Application Data

(60) Provisional application No. 63/082,046, filed on Sep. 23, 2020.

(51) Int. Cl.

| | |
|---|---|
| ***B65D 69/00*** | (2006.01) |
| ***A45C 5/00*** | (2006.01) |
| ***A45C 13/02*** | (2006.01) |
| ***A45C 13/10*** | (2006.01) |
| ***A45C 15/04*** | (2006.01) |

(52) U.S. Cl.

CPC ..... *A45C 5/005* (2013.01); *A45C 13/02* (2013.01); *A45C 13/103* (2013.01); *A45C 15/04* (2013.01)

(58) Field of Classification Search

CPC ..... A45C 5/005; A45C 11/008; A45C 13/02; A45C 13/103; A45C 15/04; A45F 3/02

USPC ..... 206/5, 5.1, 6, 581; 150/112; 383/38–40

See application file for complete search history.

(56) References Cited

U.S. PATENT DOCUMENTS

| | | | | |
|---|---|---|---|---|
| 2,612,199 | A * | 9/1952 | Schocket | A45C 3/06 312/297 |
| 2,843,170 | A * | 7/1958 | Frankfurt | A45C 11/24 150/112 |
| 4,192,365 | A * | 3/1980 | Siegel | A45C 3/06 150/112 |
| 4,739,809 | A * | 4/1988 | Adams | A45C 3/06 206/823 |
| 6,637,484 | B1 * | 10/2003 | Kraft | A45C 7/0095 150/112 |
| 9,186,284 | B1 * | 11/2015 | Hernandez | A61F 13/55135 |
| 2007/0090014 | A1 * | 4/2007 | Wheeler | A45C 5/005 206/581 |
| 2008/0060972 | A1 * | 3/2008 | Rappaport | A45C 15/00 383/117 |

* cited by examiner

*Primary Examiner* — Luan K Bui

(74) *Attorney, Agent, or Firm* — Brennan, Manna & Diamond, LLC

(57) ABSTRACT

The present invention relates to a make-up organizer bag designed to keep cosmetic items within a purse organized and accessible. The make-up organizer bag can be easily placed within a purse or handbag. The bag includes a flap and a main body wherein the flap covers the make-up items and other accessories placed within the main body. The main body is formed of a pair of side walls, a front wall and a rear wall and includes a plurality of compartments separated through elastic dividers. The dividers can be displaced to customize the size of the compartments. The bag includes a plurality of zipper closures, an elastic tube to organize and store make-up brushes and to assist with sealing the cover to the main body. The bag ensures that expensive products are always organized and that contents are protected from damage and spillage.

20 Claims, 3 Drawing Sheets

MAKE-UP ORGANIZER

CROSS-REFERENCE TO RELATED APPLICATION

The present application claims priority to, and the benefit of, U.S. Provisional Application No. 63/082,046, which was filed on Sep. 23, 2020 and is incorporated herein by reference in its entirety.

FIELD OF THE INVENTION

The present invention relates generally to the field of wallets and purses. More specifically, the present invention relates to a billfold-like make-up organizer device designed to hold a variety of cosmetic items, and allows users to fill the device with various products and then place it within a purse. The make-up organizer of the present invention prevents make-up items from cluttering the inside of a purse or spilling inside the bag and causing damage. The organizer enables users to quickly and easily locate the desired cosmetic item. The invention ensures expensive products are always organized and damage-free. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, women generally use make-up of various kinds and colors of cosmetics to express their unique personality and appearance beauty. Various kinds of cosmetics such as lipsticks, foundations, moisturizers, eye shadows, etc. are usually carried by the women in their purse, while travelling or when away from the home. The cosmetics need to be readily available to perform a touch-up during the day or when away from home. The cosmetic items, when kept in a bag or purse, are often tossed inside the bag, which results in a disorganized purse containing unnecessary clutter. In such a cluttered purse, an individual can neither find the cosmetics readily, nor can they locate other items such as keys, phone or the like which are usually kept in the purse.

Additionally, it can also take a great deal of time to locate a specific item inside the purse when there is no method of organization. This lack of organization consumes a lot of time and leads to frustration for the users while attempting to find specific items in a cluttered bag or purse. Furthermore, cosmetic items can melt, leak, or spill inside a purse. This can not only damage other expensive cosmetic items but will also damage the purse or handbag of the user. This causes loss and damage of expensive items which ultimately leads to more expense of the users.

To overcome such issues, individuals can buy a separate bag for storing cosmetics. However, even in those bags, different cosmetic items can easily get cluttered and spill inside the smaller bag. Also, individuals can still not be able to find the right cosmetic items readily and can be left frustrated. Additionally, they may have to carry a separate cosmetic bag along with their purse or bag while going out, which can be difficult and cumbersome to carry and handle.

Therefore, there exists a long felt need in the art for a cosmetic organizer device that can be used to store cosmetic items in an organized manner, and that can be easily carried and integrated with the usual purse or bag. Additionally, there is a long felt need in the art for a cosmetic organizer device that prevents cosmetic items from being tossed haphazardly inside a bag or purse, and that prevents the bags from becoming cluttered. Moreover, there is a long felt need in the art for a cosmetic organizer device that enables the user to easily and readily find the desired cosmetic items within the organizer, and that prevents cosmetic items from melting, leaking or spilling inside the bag. Still further, there is a long felt need in the art for a cosmetic organizer device that prevents a handbag or purse from becoming dirty and/or damaged as a result of cosmetic items spilling, melting, etc., and that can be easily carried along with typical handbags or purses, thereby ensuring expensive products are always organized and protected from damage. Finally, there is a long felt need in the art for a cosmetic organizer device that is relatively inexpensive to manufacture and that is both safe and easy to use.

The subject matter disclosed and claimed herein, in one embodiment thereof, comprises a make-up organizer bag designed to hold a variety of cosmetic items. The make-up organizer comprises: a main body having a front wall; a rear wall; a pair of side walls; the main body having a plurality of compartments separated by a plurality of elastic dividers; a flap to cover the compartments and the stored items in the compartments; the flap having a viewing mirror to view one's face while applying make-up; a snap fastener having a snap button on the flap and a snap hook on the front wall to fasten the flap with the front wall; the flap is attached to the rear wall; and, the organizer bag including a plurality of zipper pouches to store accessories. The bag can include an elastic tube along the width of the bag, sewn or attached to the flap for storing one or more make-up brushes.

In this manner, the novel make-up or cosmetic organizer bag of the present invention accomplishes all of the forgoing objectives, and provides a relatively safe, easy and convenient solution of carrying, storing, and organizing cosmetic items during transport and while travelling. The make-up or cosmetic organizer bag of the present invention is also user friendly, as it enables the user to easily find the desired cosmetic items as required and prevents expensive cosmetics and handbags from being damaged.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a make-up organizer bag designed to hold a variety of cosmetic items. The make-up organizer comprises: a main body having a front wall; a rear wall; a pair of side walls; the main body having a plurality of compartments separated by a plurality of elastic dividers; a flap to cover the compartments and the stored items in the compartments; the flap having a viewing mirror to view face while applying make-up; a snap fastener having a snap button on the flap and a snap hook on the front wall to fasten the flap with the front wall; the flap is attached to the rear wall; and, the organizer bag including a plurality of zipper pouches to store accessories. The bag can include an elastic tube along the width of the bag sewn or attached to the flap for storing one or more make-up brushes.

In a further embodiment of the present invention, an organizer bag for storing make-up items and other accessories in an organized manner is disclosed and comprises: a flap connected to a main body along a perimeter edge of a rear wall of the main body; the flap having an exterior surface including a logo or trademark; the flap further having an interior surface including a viewing mirror; a snap button; an elastic tube; the flap is releasably fastened to a front wall of the main body via the snap button; the main body having a plurality of compartments separated by a plurality of elastic dividers wherein the size of the compartments can be customized by displacing the elastic dividers; the front wall having a zipper closure; and, the bag includes a second zipper closure along the perimeter edge of the rear wall. The exterior surface of the organizer bag can be available in a wide variety of colors and designs. The organizer bag is portable, lightweight and can be placed easily and conveniently within a purse or handbag. The exterior surface is relatively hard and rigid to protect the expensive make-up items from being damaged. The organizer bag provides quick and easy access to stored items. The compartments are easily accessible and the individual items can be stored in an organized manner. All the pouches and pockets can have zipper closures or any other fastening mechanism. One or more exterior surfaces can have flat pockets.

The attached mirror is used for viewing the face while applying make-up, and the bag opens up to reveal slots or compartments for the placement of various cosmetic items. The bag of the present invention is sized to be carried, retained, and stored inside a purse or handbag. The make-up organizer bag can be used by anyone desiring to travel with make-up while away from the home, such as make-up artists and beauticians. The bag allows storage of a variety of make-up items without causing damage to the items, while also saving time and effort to store, find, and retrieve items.

Each elastic divider used in the present invention can be made out of compression-molded material, which can include plastic, rubber, composite material, or the like. The make-up organizer bag is weatherproof, abrasion free, lightweight, durable and made up of ecofriendly material.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
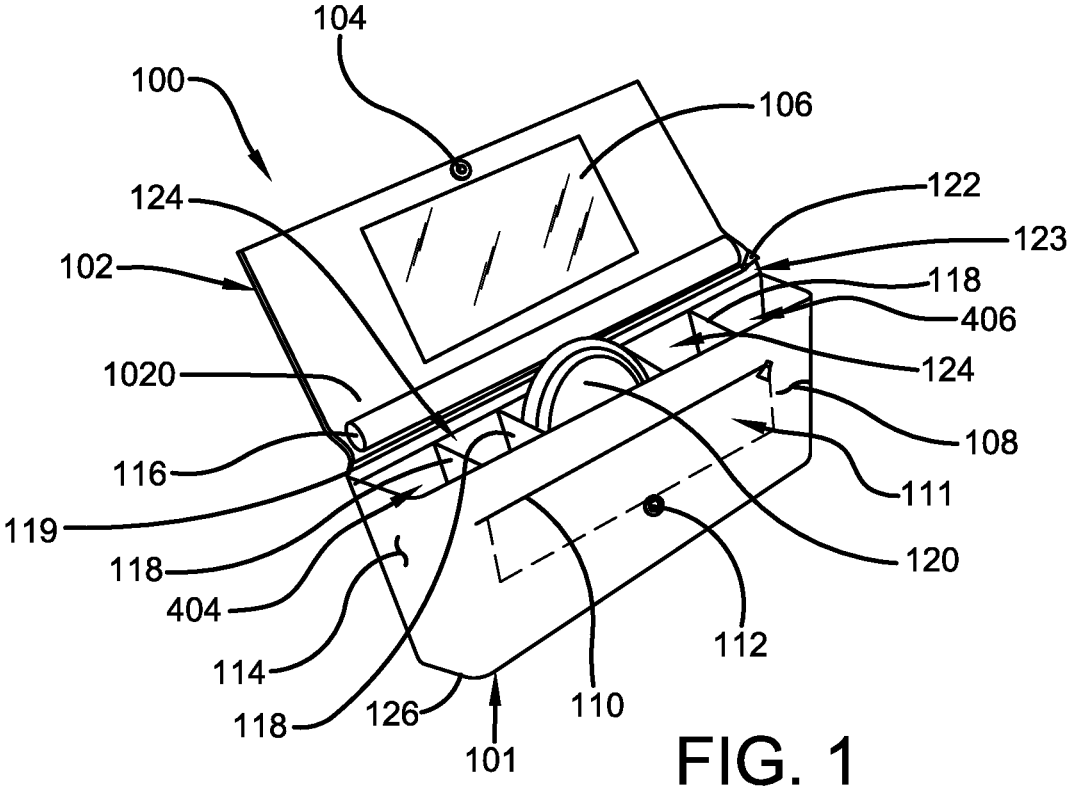
FIG. 1 illustrates a perspective view of one potential embodiment of a make-up organizer bag of the present invention in an opened position and in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It can be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments can be combined.

As noted above, there is a long felt need in the art for a cosmetic organizer that can be used to store cosmetic items in an organized manner, and that can be easily carried and integrated with existing purses or handbags. There is a long felt need in the art for a cosmetic organizer device that enables the user to easily and readily find the desired cosmetic items within the organizer, and that prevents cosmetic items from melting, leaking or spilling inside the bag. Additionally, there is a long felt need in the art for a cosmetic organizer device that prevents cosmetic items from being tossed haphazardly inside a bag or purse, thereby preventing bags from becoming cluttered. Still further, there is a long felt need in the art for a cosmetic organizer device that prevents a handbag or purse from becoming dirty and/or damaged as a result of cosmetic items spilling, melting, etc., that can be easily carried along with typical handbags or purses, and that ensures expensive products are always organized and protected from damage. Finally, there is a long felt need in the art for a cosmetic organizer device that is relatively inexpensive to manufacture and that is both safe and easy to use.

The present invention, in one exemplary embodiment, comprises a make-up organizer bag designed to hold a variety of cosmetic items. The make-up organizer comprises: a main body having a front wall; a rear wall; a pair of side walls; the main body having a plurality of compartments separated by a plurality of elastic dividers; a flap to cover the compartments and the stored items in the compartments; the flap having a viewing mirror to view one's face while applying make-up; a snap fastener having a snap button on the flap and a snap hook on the front wall to fasten the flap with the front wall; the flap is attached to the rear wall; and, the organizer bag including a plurality of zipper pouches to store accessories. The bag can include an elastic tube along the width of the bag, sewn or attached to the flap for storing one or more make-up brushes.

Referring initially to the drawings, FIG. 1 illustrates a perspective view of one potential embodiment of the make-up organizer bag of the present invention in accordance with the disclosed structure. The make-up organizer bag 100 is similar to a billfold or wallet, including nylon material comprising the exterior surface and breathable flexible material comprising the interior surfaces. The make-up organizer bag 100 includes a plurality of compartments and zipper pouches to hold a variety of cosmetic items. The organizer bag 100 can be easily placed within a handbag or purse for easy carrying, allowing expensive make-up products remain organized and free of damage.

The organizer bag 100 includes a cover or flap 102 and a base 101 for securing the contents of the organizer bag 100 therein. The cover 102 includes an interior surface 1020 having a small mirror 106 for viewing the face while applying make-up. The bag 100 further includes a snap button 104 for attachment to a snap hook 112 present on a front wall 108 of the base 101 of the organizer bag 100. The cover 102 includes flexible material and covers the compartments within the base 101 of the organizer bag 100. The mirror 106 is attached to the interior surface 1020 by an adhesive layer.

The make-up organizer bag 100 includes a plurality of compartments 124 to store the make-up items wherein the compartments are divided via elastic dividers 118. Each compartment 124 can be customized in volume using the elastic dividers 118 in order to selectively size the compartments for retaining and accommodating make-up items 120 such as lip gloss, lipstick, powder, etc. A zipper 122 selectively opens and closes another interior compartment or pocket 123 present along a rear side of the base 101. The pocket 123 generally spans the length and height of a base 101 of the bag 100 to store foundation, powder or any other make-up item.

The make-up organizer bag 100 comprises the main body or base 101 having a pair of opposing side walls 114, 115, a front wall 108, and a rear wall 109, wherein the walls form a cavity including the compartments 124 divided by elastic dividers 118 therein. The zipper 122 and pocket 123 defines another space within the cavity, formed by the rear wall 109 and another interior wall 119. The front wall 108 includes yet another zipper 110 for selectively opening and closing a pouch 111 to store small, relatively lightweight brushes and other make-up items. The front wall 108 includes the snap hook 112 to engage with the snap button 104. The first side wall 114 and the second side wall 115 provide side support to the base 101 and the compartments therein. Each compartment 124 is further supported by the rear wall 109 and the front wall 108. The main body or base 101, in one potential embodiment, is generally rectangular in shape; however, alternative shapes can be used such as oval, circular or the like.

The make-up organizer bag 100 provides a secure enclosure for make-up items of various sizes and kinds, thereby allowing quick and easy access to the make-up items. The cover or flap 102 secures the contents stored in the compartments and can be secured to the front wall 108 with snaps, magnetic snaps, buckles, fabric hook-and-loop strips or the like.

The outer body of the make-up organizer bag 100 according to the invention can be made of any number of materials, such as nylon, canvas, synthetic materials including microfibers, other rugged and durable materials, or combinations thereof. The material can be tear-resistant, water-repellent and mildew-resistant fabric.

A small elastic tube or pouch 116 having an internal storage space for one or more make-up brushes is also attached or sewn to the interior surface 1020 of the cover 102. The small elastic tube 116 can extend generally along the complete length of the cover 102. Due to the flexible nature of the zipper 122 and pocket 123, the elastic tube 116 does not inhibit the movement of the cover or flap 102 when the tube 116 is secured to the interior surface 1020 of the cover 102. A user's individual needs and tastes can be met by smaller or larger make-up organizer bags, which all fall within the scope of this invention. Additionally, the organizer bags can be made in several different shapes.

In other potential embodiments (not illustrated), the side walls can have zipper pouches to increase the storage space for make-up items. It is to be appreciated that the pocket 123 described in the present organizer bag 100 extends generally to the bottom 126 of the organizer bag 100. The make-up organizer bag 100 can be easily placed within a larger purse or handbag.

Figure 2:
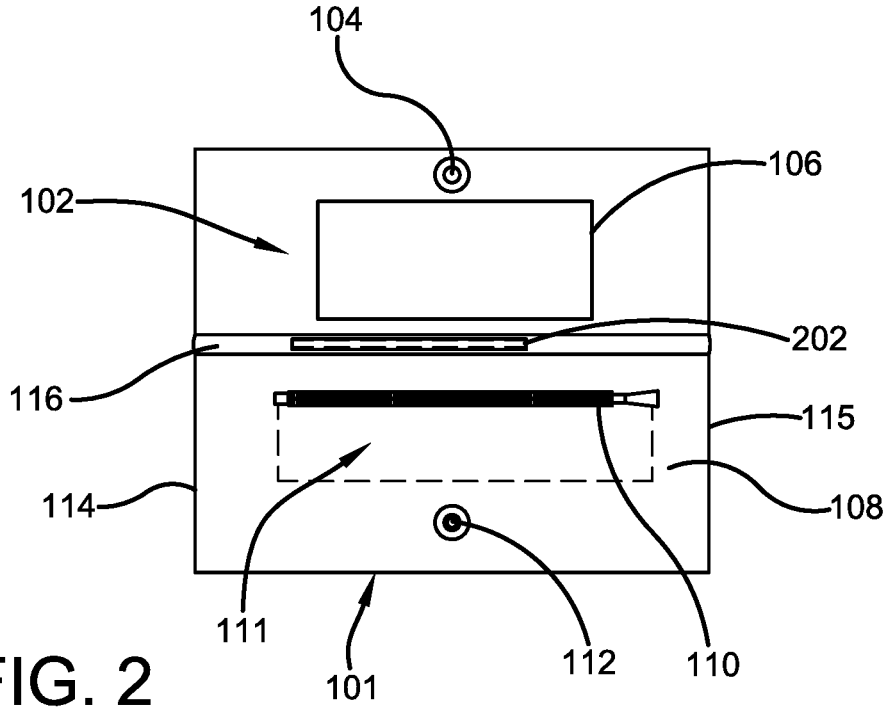
FIG. 2 illustrates a front perspective view of one potential embodiment of the make-up organizer bag of the present invention in an opened position and in accordance with the disclosed architecture.

FIG. 2 illustrates a front perspective view of one potential embodiment of the make-up organizer bag of the present invention in accordance with the disclosed structure. The front wall 108 is generally rectangular in shape and includes a zipper 110 and pouch 111, which can be accessed from the front wall 108. In place of a zipper fastening mechanism, a hook and loop fastener can be used to secure the contents of the pouch 111. When the flap 102 is open or unfastened the mirror 106, attached via an adhesive, can be used to assist with the application of make-up. The snap button 104 can be engaged with the snap hook 112 to protect and cover the items stored in the main body 101. The small elastic pouch 116 is easily accessed for storage of a make-up brush 202 retained in the elastic pouch 116. The elastic pouch 116 can have a closed end or alternatively, can be open at both ends. Each zipper closure 110, 122 of the make-up organizer bag 100 can be made of metal, nylon, plastic or any other suitable material, and can be straight, curved, flat, hidden or "invisible." The zipper 110 and pouch 111 extend generally across the front wall 108.

Figure 3:
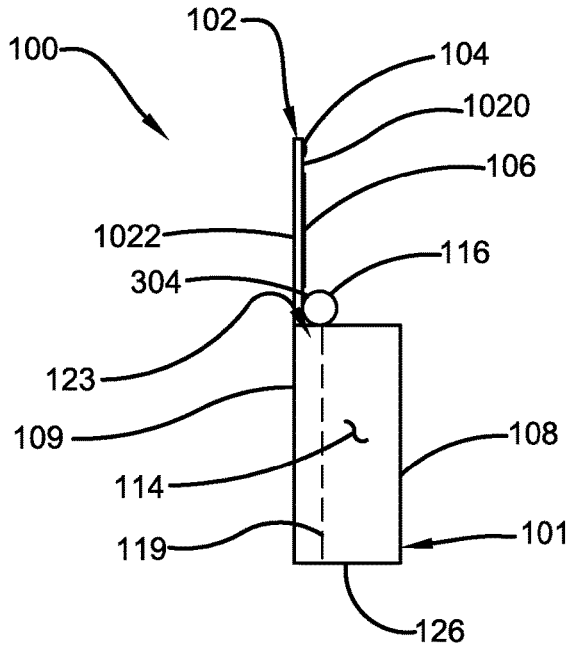
FIG. 3 illustrates a side perspective view of one potential embodiment of the make-up organizer bag of the present invention in an opened position and in accordance with the disclosed structure.

FIG. 3 illustrates a side perspective view of one potential embodiment of the make-up organizer bag of the present invention in accordance with the disclosed architecture. The side wall 114 is a rectangular-shaped wall and the rear wall 109 can have any design or trademark. The flap 102 includes a mirror 106 and a snap button 104 affixed to the interior surface 1020, and the exterior surface 1022 can have a logo or trademark. The elastic pouch 116 includes an opening 304 into which a make-up brush 202 can be inserted into the elastic pouch for access as well. The height of the side wall 114 can be slightly more than the height of the flap 102.

Figure 4:
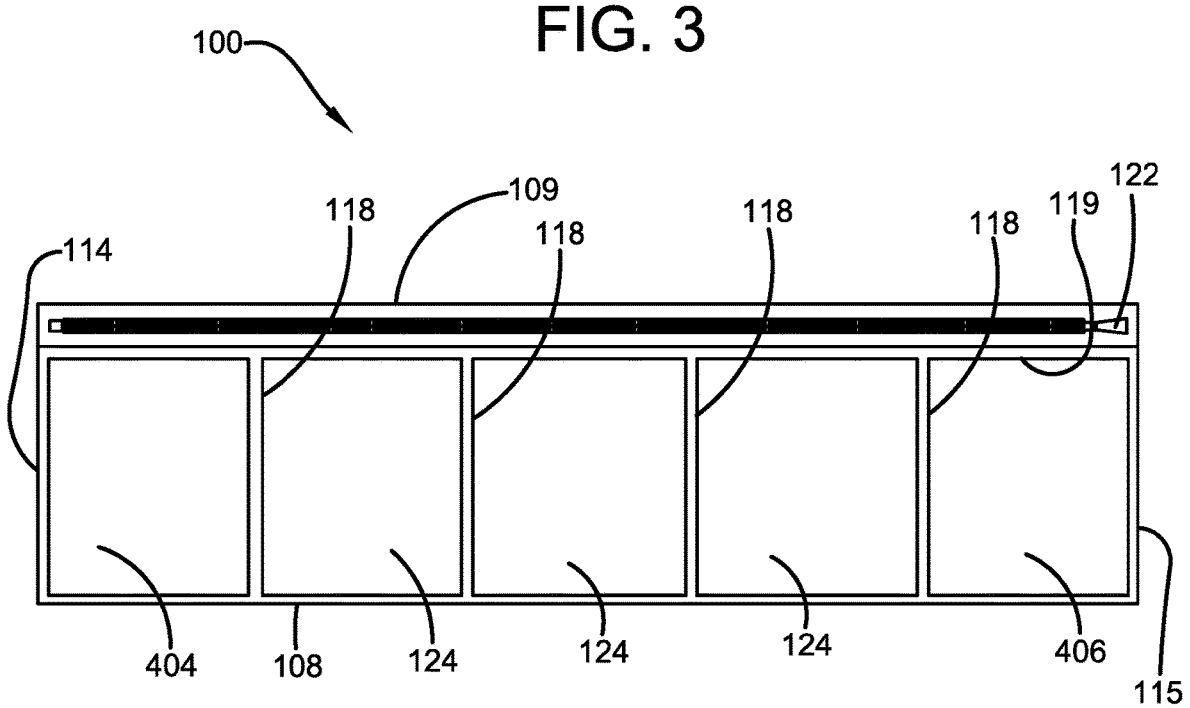
FIG. 4 illustrates a top partial perspective view of one potential embodiment of the main body of the make-up organizer bag of the present invention in accordance with the disclosed architecture, wherein the elastic dividers and compartments are clearly displayed.

FIG. 4 illustrates a top partial plan view of the main body showing elastic dividers and compartments in the make-up organizer bag of the present invention in accordance with the disclosed structure. The bag includes a plurality of elastic dividers 118, which can be customized to increase or decrease the size of one or more compartments 124. The compartments 124 are used to store the make-up items. The extreme left compartment 404 and the extreme right compartment 406 are supported by the first side wall 114 and the second side wall 115, respectively. The compartments in the main body are supported by the front wall 108 and the interior wall 119. Each compartment can be customized in size by displacing and the elastic dividers 118.

Figure 5:
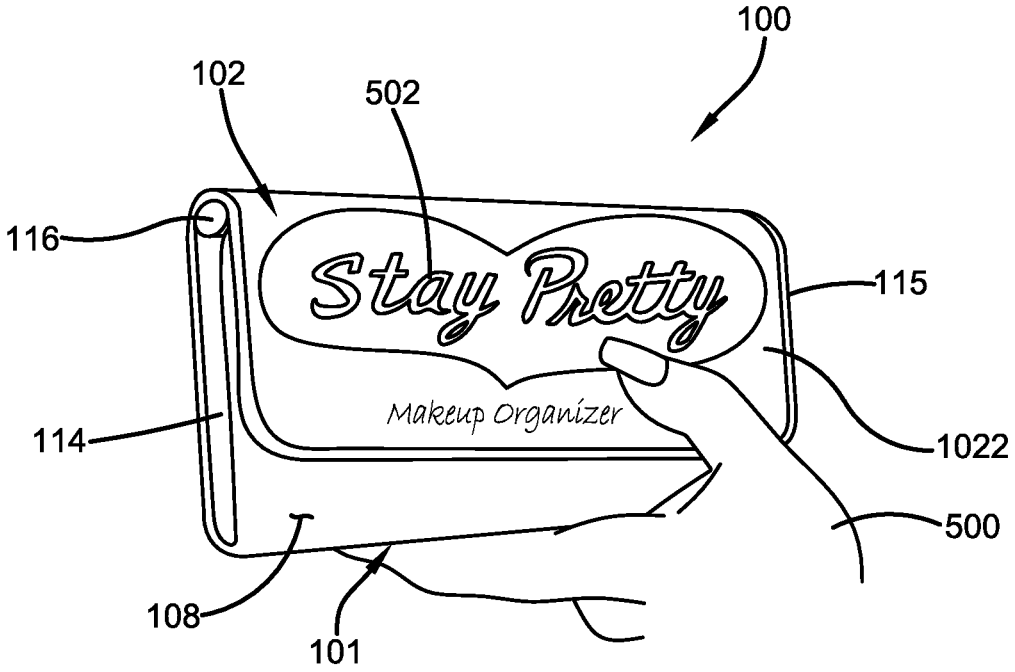
FIG. 5 illustrates a perspective view of one potential embodiment of a make-up organizer bag of the present invention in a closed position and being carried by an individual in accordance with the disclosed architecture.

FIG. 5 illustrates a user carrying the make-up organizer bag of the present invention in a single hand in accordance with the disclosed structure. As shown, the make-up organizer bag 100 can be easily carried in a single hand 500 and can be placed in a handbag or purse (not illustrated). The exterior surface 1022 of the cover 102 can have a logo or trademark 502 for branding, and the logo can be affixed or sewn. The flap or cover 102 covers the contents of the main body 101 and is engaged to the front wall 108 using the snap button or any other fastener. It should be noted that the organizer bag 100 is similar in design to a billfold/wallet. The organizer bag 100 can be placed comfortably, in an upright orientation, within a purse or handbag. Further, due to the flexibility of the components 116, 122, and 123, when the flap 102 is in the closed position (see e.g., FIG. 5), the elastic tube 116, along with the flap 102 secured to the front wall 108, provide a sealed bag 100. The closed and sealed bag prevents the spillage of contents contained within the bag 100. It is to be appreciated that the ends of the elastic tube provide access thereto while the cover is secured to said base.

Figure 6:
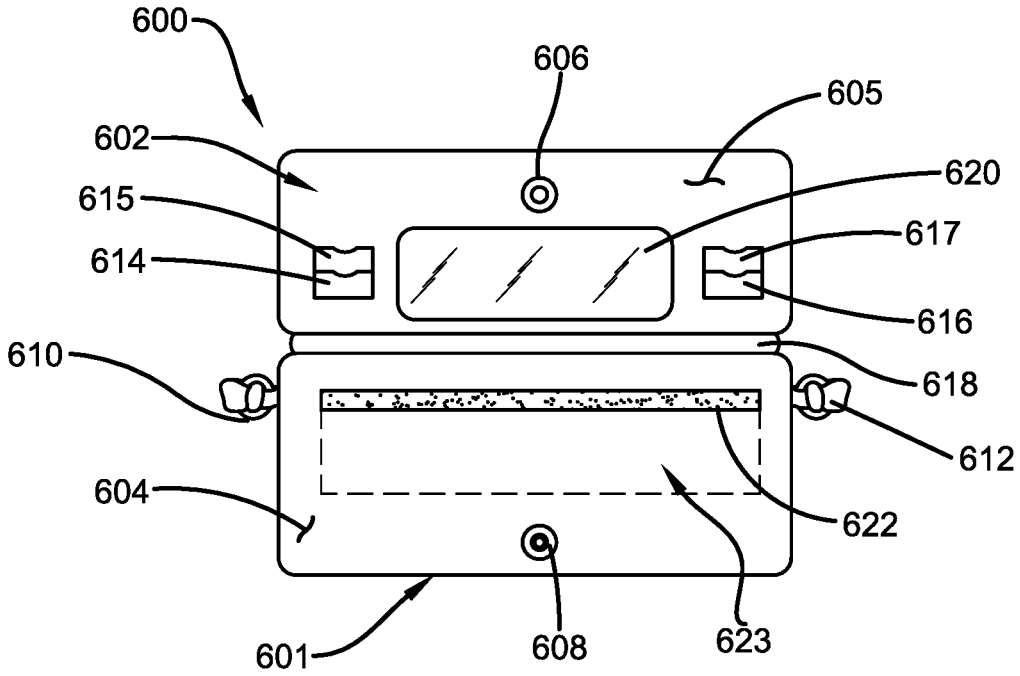
FIG. 6 illustrates a perspective view of another potential embodiment of the make-up organizer bag of the present invention in an opened position and in accordance with the disclosed architecture.

FIG. 6 illustrates a perspective view of another potential exemplary embodiment of the make-up organizer bag of the present invention in accordance with the disclosed structure. As shown, the organizer bag 600 of the present embodiment, includes a base 601, a top flap 602 and a front wall 604. The flap 602 includes an inner surface 605 having a mirror 620 symmetrical to the shape of the flap 602 mounted thereto. The interior surface 605 of flap 602 can have a pair of inner pouches 614, 616 to store small items. The inner pouches 614, 616 can include closures 615, 617 for securing the stored items. The organizer bag 600 uses a magnetic button 606 and a magnetic hook 608 to attach the flap 602 to the main body 601 via the front wall 604.

A small elastic tube 618 having storage space for one or more make-up brushes is also attached or sewn to the interior surface 605 of the flap 602. The present embodiment includes a pair of buckles 610, 612, to which a strap can be attached and can be worn as a sling bag. The front wall 604 includes a pouch 623 with a hook and loop closure 622.

It should be appreciated that the compartments or slots and the elastic dividers can be present in all the embodiments of the present invention. All types of make-up items can be stored in the make-up organizer bag of the present invention, without any clutter and in an organized manner. The organized bag 100, 600 of the present invention is perfect for storing make-up items or skin care essentials. The bag 100, 600 is machine washable and hand washable. The bag is perfect to organize make-up items in another handbag, or just to carry on its own as a clutch or a sling bag.

In one embodiment, the dimensions of the organizer bag are generally 8 inches in length, 3 inches in depth and 5 inches in height. Alternatively, the dimensions of the organizer bag are 4 inches in length, 2 inches in depth and 3 inches in height. The zipper closures 110, 122 of the bag can be made of brass. The bag acts as a versatile organizer bag to organize all essentials such as toiletries, cosmetics, art supplies, tools, pencils and other personal items.

The walls of the organizer bag are relatively rigid to protect the make-up items. The adjustable dividers 118 allow for multiple uses, and the elastic tubes 116, 618 protect brushes mounted therein from dirt and other contaminants. The other zipper pockets and pouches 111, 123 are big enough to hold make-up palettes. The compartments 124 can store eye shadow, lipsticks, powders, etc.

The material used for the organizer bag of the present invention can be any expandable material, such as stretchy or pleated materials. Ideally, the material is also waterproof, or at least water-resistant. The materials have the characteristics of durability, expandability, water resistance, and aesthetically-pleasing texture and appearance.

The make-up organizer bag of the present invention is compatible with a low cost of manufacture regarding both materials and labor, and accordingly is then compatible with low prices of sale to the consuming public, thereby making such organizer bag economically available to the buying public.

Certain terms are used throughout the following description and claims to refer to particular features or components. As one skilled in the art will appreciate, different persons can refer to the same feature or component by different names. This document does not intend to distinguish between components or features that differ in name but not structure or function. As used herein "make-up organizer bag", "organizer bag", "make-up bag", and "make-up items carrying bag" are interchangeable and refer to the make-up organizer bag 100, 600 of the present invention.

Notwithstanding the forgoing, the make-up organizer bag 100, 600 of the present invention can be of any suitable size and configuration as is known in the art without affecting the overall concept of the invention, provided that it accomplishes the above-stated objectives. One of ordinary skill in the art will appreciate that the size, configuration and material of the make-up organizer bag 100, 600 as shown in the FIGS. are for illustrative purposes only, and that many other sizes and shapes of the make-up organizer bag 100, 600 are well within the scope of the present disclosure. Although the dimensions of the make-up organizer bag 100, 600 are important design parameters for user convenience, the make-up organizer bag 100, 600 can be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features, and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A make-up storage device configured to provide partitioned storage of multiple items, the make-up storage device comprising:

a storage base including a plurality of base compartments, wherein said storage base includes retention mechanisms for retaining contents in said plurality of base compartments;

said plurality of base compartments comprises at least three open compartments separated by dividers in said base, wherein said dividers are elastic;

a pouch within a front wall of said base, wherein said pouch retention mechanism comprises a zipper;

a pocket within a rear wall of said base, wherein said pocket retention mechanism comprises a zipper;

a cover selectively securable to said base, wherein said cover including at least one cover storage compartment;

said cover includes retention mechanisms for retaining contents in said at least one cover storage compartment;

said at least one cover storage compartment retention mechanism comprises an elastic tube:

said cover selectively closes said storage base, wherein closing said storage base closes said at least three open compartments; and said elastic tube and said cover provide a sealed said storage base when said cover is secured to said base.

2. The make-up storage device of claim 1, wherein said storage base includes a length, a depth and a height;

said storage base length is generally about 4 inches to about 8 inches;

said storage base depth is generally about 2 inches to about 3 inches; and said storage base height is generally about 3 inches to about 5 inches.

3. The make-up storage device of claim 1, wherein said elastic tube provides access to at least one end of said elastic tube when said cover is secured to said base.

4. The make-up storage device of claim 3, wherein said elastic tube provides access to both ends of said elastic tube when said cover is secured to said base.

5. The make-up storage device of claim 1, wherein said plurality of base compartments comprises at least four open compartments separated by said dividers in said base.

6. The make-up storage device of claim 5, wherein said dividers are displaceable to customize a size of said plurality of base compartments.

7. The make-up storage device of claim 6, further comprising a mirror mounted to an inside surface of said cover.

8. The make-up storage device of claim 7, wherein said cover further comprises at least a second cover storage compartment and a third cover storage compartment.

9. The make-up storage device of claim 8, wherein said cover and said base further comprise a retention mechanism, wherein said cover includes a snap button and said base includes a snap hook for selective retention of said cover to said base.

10. The make-up storage device of claim 9, wherein said cover and said base comprise water-resistant material.

11. The make-up storage device of claim 9, wherein said cover and said base comprise waterproof material.

12. A make-up storage device configured to provide partitioned storage of multiple items, the make-up storage device comprising:

a storage base including a plurality of base compartments, wherein said storage base includes retention mechanisms for retaining contents in said plurality of base compartments;

said plurality of base compartments comprises at least two open compartments separated by dividers in said base, wherein said dividers are elastic;

a pocket within a rear wall of said base, wherein said pocket retention mechanism comprises a zipper;

a cover selectively securable to said base, wherein said cover including at least one cover storage compartment;

said cover includes retention mechanisms for retaining contents in said at least one cover storage compartment;

said at least one cover storage compartment retention mechanisms comprise an elastic tube having elastic openings at opposing ends of said elastic tube;

said cover selectively closes said storage base, wherein closing said storage base closes said at least two open compartments; and said elastic tube and said cover provide a sealed said storage base when said cover is secured to said base.

13. The make-up storage device of claim 12, wherein said storage base includes a length, a depth and a height;

said storage base length is generally about 4 inches to about 8 inches;

said storage base depth is generally about 2 inches to about 3 inches; and said storage base height is generally about 3 inches to about 5 inches.

14. The make-up storage device of claim 12, wherein said elastic tube provides access to both ends of said elastic tube when said cover is secured to said base.

15. The make-up storage device of claim 14, further comprising a pouch within a front wall of said base, wherein said pouch retention mechanism comprises a zipper.

16. The make-up storage device of claim 15, wherein said plurality of base compartments comprises at least four open compartments separated by said dividers in said base.

17. The make-up storage device of claim 16, wherein said dividers are displaceable to customize a size of said plurality of base compartments.

18. The make-up storage device of claim 17, wherein said cover and said base further comprise a retention mechanism, wherein said cover includes a snap button and said base includes a snap hook for selective retention of said cover to said base.

19. The make-up storage device of claim 18, wherein said cover and said base comprise water-resistant material.

20. The make-up storage device of claim 18, wherein said cover and said base comprise waterproof material.

* * * * *